US007984869B2

(12) United States Patent
Musselman

(10) Patent No.: US 7,984,869 B2
(45) Date of Patent: Jul. 26, 2011

(54) FACE MOUNTED INSTALLATION FIXTURE AND ASSOCIATED METHODS

(75) Inventor: Ron Musselman, Lewisburg, PA (US)

(73) Assignee: Andritz Inc., Glens Falls, NY (US)

( * ) Notice: Subject to any disclaimer, the term of this patent is extended or adjusted under 35 U.S.C. 154(b) by 49 days.

(21) Appl. No.: 12/367,391

(22) Filed: Feb. 6, 2009

(65) Prior Publication Data

US 2009/0230226 A1 Sep. 17, 2009

Related U.S. Application Data

(60) Provisional application No. 61/035,883, filed on Mar. 12, 2008.

(51) Int. Cl.
*B02C 7/12* (2006.01)

(52) U.S. Cl. ..... 241/298

(58) Field of Classification Search ..... 241/261.2, 241/261.3, 296, 297, 298; 29/426.1, 428, 29/525.11

See application file for complete search history.

(56) References Cited

U.S. PATENT DOCUMENTS 5,979,809 A * 11/1999 Bartels et al. ..... 241/261.3

* cited by examiner

*Primary Examiner* — Mark Rosenbaum
(74) *Attorney, Agent, or Firm* — Nixon & Vanderhye P.C.

(57) ABSTRACT

A face-mounted carrier for transporting a refiner plate segment for refining lignocellulosic material to a refiner disk. The refiner plate segment may contain threads that facilitate bolting to the face-mounted carrier and bolting to the refiner disk.

11 Claims, 3 Drawing Sheets

FACE MOUNTED INSTALLATION FIXTURE AND ASSOCIATED METHODS

RELATED APPLICATION

This application claims the benefit of priority to U.S. Provisional Patent Application No. 61/035,883 filed Mar. 12, 2008, the entirety of which is incorporated by reference herein.

BACKGROUND OF THE INVENTION

This invention generally relates to refiners for lignocellulosic materials, and more specifically to a method and system for changing refiner plate segments in such a refiner.

Refiner plate segments are a critical component of the refining equipment. They are also a wear part that requires changing on a regular basis, in order to maintain the refining performance over time. A typical circle of refiner plates is composed of anywhere between 3 and 24 equally-sized segments, which together form a circle. At most, if not all, refiner plate changes, all segments are removed; the mounting surfaces (that is, the surfaces of the rotor and stator disk) are cleaned; and the new refiner segments are installed one-by-one, including shimming them to keep equal spacing and torquing the attachment bolts properly.

Refiners usually have 2 circles of plates running opposite each other, or in case of Twin refiners, they have 4 circles of plates (including a double-sided rotor). The refiner may be made with one rotor facing one stator (a rotating disk facing a stationary disk), or two opposing counter-rotating rotors.

Currently segmented refiner plates are either mounted individually to the rotor or stator surfaces in the refiner or fixed to separate plate holders that are of sufficient thickness to contain the full length of the required segment attachment bolts. These separate plate holders are then attached to the grinding machine as a complete assembly after the segments are fixed to the plate holder.

Converting machines not originally equipped with these thick plate holders may typically require a major rebuild of the machine as the plate holder thickness must be removed from the rotor and stator surfaces to allow the added thickness of the plate holders. This is a time consuming and costly process.

In certain aspects, the present invention may provide the labor saving and ergonomic benefits of the thick plate holder concept without the requirement for an extensive machine rebuild and the associated cost. Additional labor savings may be realized at the mill site when the face mounted carrying and installation fixture is supplied as a complete assembly with the segments precisely positioned for proper balancing required to minimize grinding machine rotational vibration. The assembly may then be ready for installation into the grinding machine as a single unit with significantly less mill site assembly labor and cost.

BRIEF DESCRIPTION OF THE INVENTION

In a preferred embodiment, there is a face-mounted carrier for transporting a refiner plate segment to a refiner disk. The refiner plate segment may be bolted to the face-mounted carrier, then bolted to the refiner disk using the same set of threads.

In a preferred embodiment, there is a refiner plate segment for refining lignocellulosic material. The refiner plate includes a top surface comprising bars and grooves for refining lignocellulosic material; a bottom surface adapted to interface with a mounting surface of a refiner; a first hole in the top surface and a second hole in the bottom surface. The first hole includes a threaded portion adapted to receive a first threaded bolt, and the second hole includes a threaded portion adapted to receive a second threaded bolt. In certain embodiments, the first hole and second hole form a single hole through the plate segment.

The refiner plate may include a top surface comprising bars and grooves for refining lignocellulosic material; a bottom surface; a hole connecting the top surface to the bottom surface. The hole may comprise a threaded portion adapted to receive a first threaded bolt from both the top surface and a second threaded bolt the bottom surface.

In a preferred embodiment, there is an assembly for transporting a refiner plate segment to a refiner refining lignocellulosic material. The assembly may include a refiner plate segment including a top surface comprising bars and grooves for refining lignocellulosic material; a bottom surface; a hole connecting the top surface to the bottom surface, wherein the hole comprises a threaded portion adapted to receive a first threaded bolt from both the top surface and a second threaded bolt the bottom surface; and a face-mounted carrier adapted to be adjacent to the top portion of the refiner plate segment and adapted to receive a bolt that is threaded into the threaded portion of the refiner plate segment.

In a preferred embodiment, there is a method of attaching a refiner plate segment to a refiner for refining lignocellulosic material, wherein the refiner plate segment comprises (a) a top surface comprising bars and grooves for refining lignocellulosic material, (b) a bottom surface for interfacing a mounting surface of the refiner, (c) a hole connecting the top surface to the bottom surface, wherein the hole comprises a threaded portion adapted to receive a first threaded bolt from both the top surface and a second threaded bolt the bottom surface. The method may include the steps of: attaching a face-mounted carrier to the refiner plate segment by threading the first threaded bolt into the threaded portion of the hole such that the face-mounted carrier is cinched between a head of the first threaded bolt and the refiner plate segment; transporting the face-mounted carrier and the refiner plate segment to the refiner and placing the refiner plate segment on the mounting surface of the refiner; attaching the refiner plate segment to the refiner by threading the second threaded bolt into the threaded portion of the hole such that the refiner plate segment is cinched to the mounting surface of the refiner; and removing the face-mounted carrier from the refiner plate segment such that the refiner may refine lignocellulosic material using the bars and grooves of the refiner plate segment. The method may involve attaching the refiner plate segment substantially simultaneously with removing the face-mounted carrier.

DETAILED DESCRIPTION OF THE INVENTION

Figure 1:
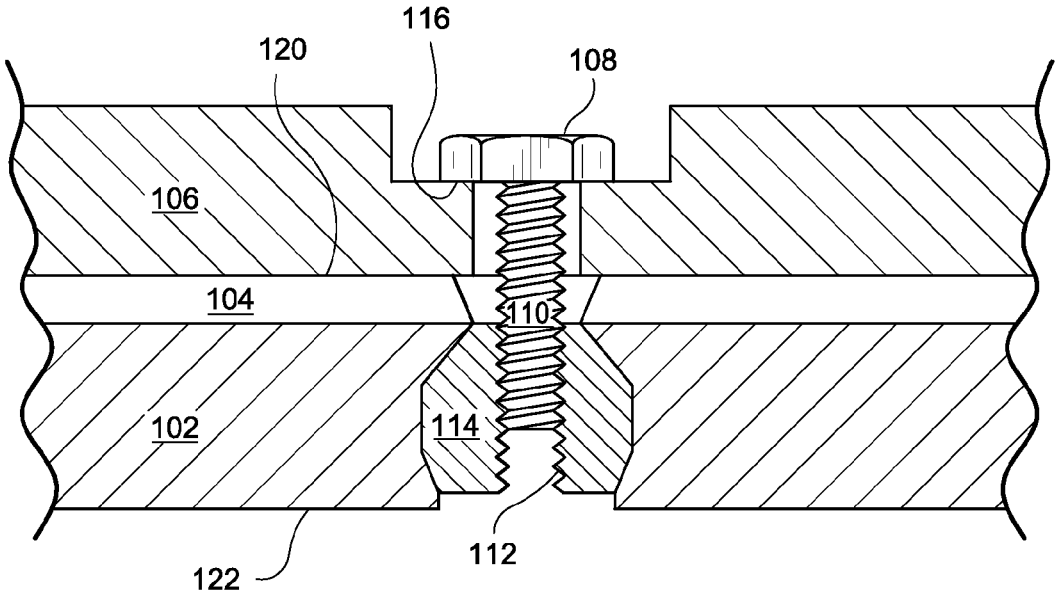
FIG. 1 schematically illustrates an assembly comprising a face-mounted fixture and refiner plate segment in accordance with an embodiment of the present invention.

This invention generally relates to refiners for lignocellulosic materials, and more specifically to a method and system for changing refiner plate segments in such a refiner. In certain embodiments, the present invention may be applicable to a broad range of refiners, e.g., those operated from a consistency range of 1 to 90%.

In certain embodiments, the present invention comprises a segment transportation and installation fixture that is attached to the grinding face of the refiner segments. Depending upon the particular grinding machine type and design, these segments may comprise a full 360 degree circle or some smaller portion, e.g., a 180 degree half-circle.

The fixture with the attached segments may be positioned as a unit onto the refiner. The plate segments may then be fixed to the rotating and stationary machine surfaces utilizing a similar attachment method as when the segments were installed individually. Once the segments are fixed to the machine surfaces, the attachment method of the face-mounted installation fixture to the segments is released, and the fixture may be removed from the machine and stored until the segments become worn and are replaced.

The fixture may also be used in removing the worn segments. The carrying fixture may be attached to the face of the worn segments. The segments may then be unbolted from the machine mounting surface and removed as a full or partial (e.g., half) circle assembly from the machine.

The segments may be fixed directly to the machine mounting surfaces. Alternatively, a thin (e.g., 1 to 4 mm thick) plate carriers may be clamped between the segment and machine surfaces to protect the machine surface from fiber and resin deposits that must be removed prior to installing another new set of segments. Suitable thin plate carriers may be described in U.S. application Ser. No. 12/269,285 to Gingras. The thin backing plate need not be attached to the machine surface; it may be sandwiched between the segment and the machine surface. In certain embodiments, a thin plate holder may be temporarily fixed to the segments and/or to the face-mounted installation fixture.

In an embodiment, the face-mounted segment carrier and installation fixture has at least one hole through which a temporary installation bolt may slide. This hole facilitates attachment of the bolt to a threaded potion of the refiner plate segment (e.g., a threaded insert). The face-mounted segment carrier along with the segment(s) may then be moved to the rotor or stator disk of the refiner. The temporary installation bolt may be removed, and a second installation bolt may be used to connect the plate segment to the refiner disk using the same threads on the plate segment as used to secure the temporary installation bolt. In some embodiments, substantially the same installation bolt may be used.

The threaded portion of the refiner plate segment may be machined directly into the refiner plate itself if the hardness of the grinding segment material is low enough to allow direct machining. Alternatively for higher hardness materials where the segment cannot be directly machined, a lower hardness insert (e.g., when compared to the refiner plate's bars and grooves) can be placed in the casting mold and the segment metal poured around it. The softer insert material can then be drilled and tapped for the attachment bolts. Such inserts are currently drilled and tapped and used for attaching the segments individually from the back side into the grinding machine but the insert surface is only exposed on the back non-grinding side of the segments.

In preferred embodiments of the present invention, an insert face would be exposed on the face side of the segment for drilling and tapping to attach the installation fixture. That is, the threaded portion of the plate segment may be accessed from both the face-side of the segment and the disk-side of the segment. Most preferably, the refiner segment has a hole completely therethrough. In some embodiments, the refiner segment has one or more holes solely accessible from one side, either the top or the bottom.

In a preferred embodiment, the same insert location in the segment may be used for face attachment of the installation fixture and backside attachment of the segment to the grinding machine mounting surface. A common insert location would allow drilling through and tapping in one operation from either the back or face side reducing machining steps and set-up time.

In some embodiments, longer bolts for segment-to-machine attachment may be used. These bolts may extend through the full length of the tapped hole and remain just below the grinding face of the segment. Filling the face side of the tapped hole with the bolt might prevent material from the grinding process from filling and plugging the tapped hole. If the tapped hole(s) were plugged with solidified material during the refining process, the face fixture attachment bolts might be difficult to insert into the tapped holes when used segments are removed.

If the bolts for segment-to-machine attachment fill the full length of the tapped insert, the bolts for carrier-to-segment attachment cannot be simultaneously threaded into these same holes. In some embodiments, there may be two (or more) holes per plate segment. Only a portion of the holes would be used to attach the segment to the carrier. That is, the carrier may be fixed to the plate segment using at least one hole, while the plate segment is fixed to the refiner disk using another hole. Once the face-mounted carrier is unbolted and removed, the now-available set of holes may be used to further bolt the segment to the refiner disk.

FIG. 1 schematically illustrates an assembly comprising a face-mounted fixture and refiner plate segment in accordance with an embodiment of the present invention. Refiner plate segment 102 has a top surface 120 and a bottom surface 122. Top surface 120 interfaces the lignocellulosic material during operation of the refiner, and the lignocellulosic material is pulverized using bars and grooves 104 near the top surface 120. The precise pattern (if any) of the grooves is relatively unimportant. Face-mounted carrier 106 is connected to refiner plate segment 102 via a bolt 110 interlocking with threads 112 of insert 114. As bolt 110 is rotated into place, head 108 cinches against face-mounted carrier 106 at interface 116.

Once assembled, the face-mounted carrier and refiner plate segment may be positioned for attachment to the rotor or stator disk of a refiner.

Figure 2:
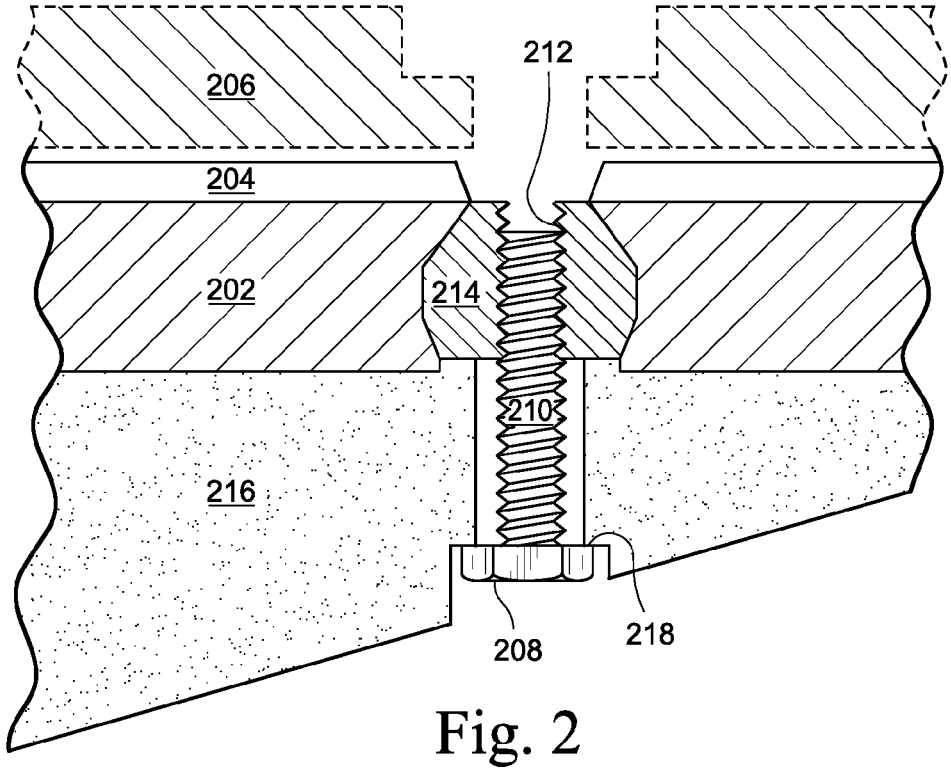
FIG. 2 schematically illustrates a refiner plate segment mounted to a refiner in accordance with an embodiment of the present invention.

FIG. 2 schematically illustrates a refiner plate segment mounted to a refiner in accordance with an embodiment of the present invention. As illustrated, the face-mounted carrier 206 may be unbolted and removed from the refiner plate segment 202, such that grooved portion 204 may exposed to lignocellulosic material during operation of the refiner. Plate segment 202 is attached to refiner disk 216 via bolt 210. Bolt 210 interfaces with threads 212 of insert 214. As bolt 210 is rotated, head 208 cinches against disk 216 at interface 218, pulling the refiner segment against the refiner disk.

The same threads used to bolt the face-mounted carrier to the refiner plate segment (e.g., threads 112 of FIG. 1) may be used to bolt the refiner plate segment to the refiner disk (e.g., threads 212 of FIG. 2).

Figure 3:
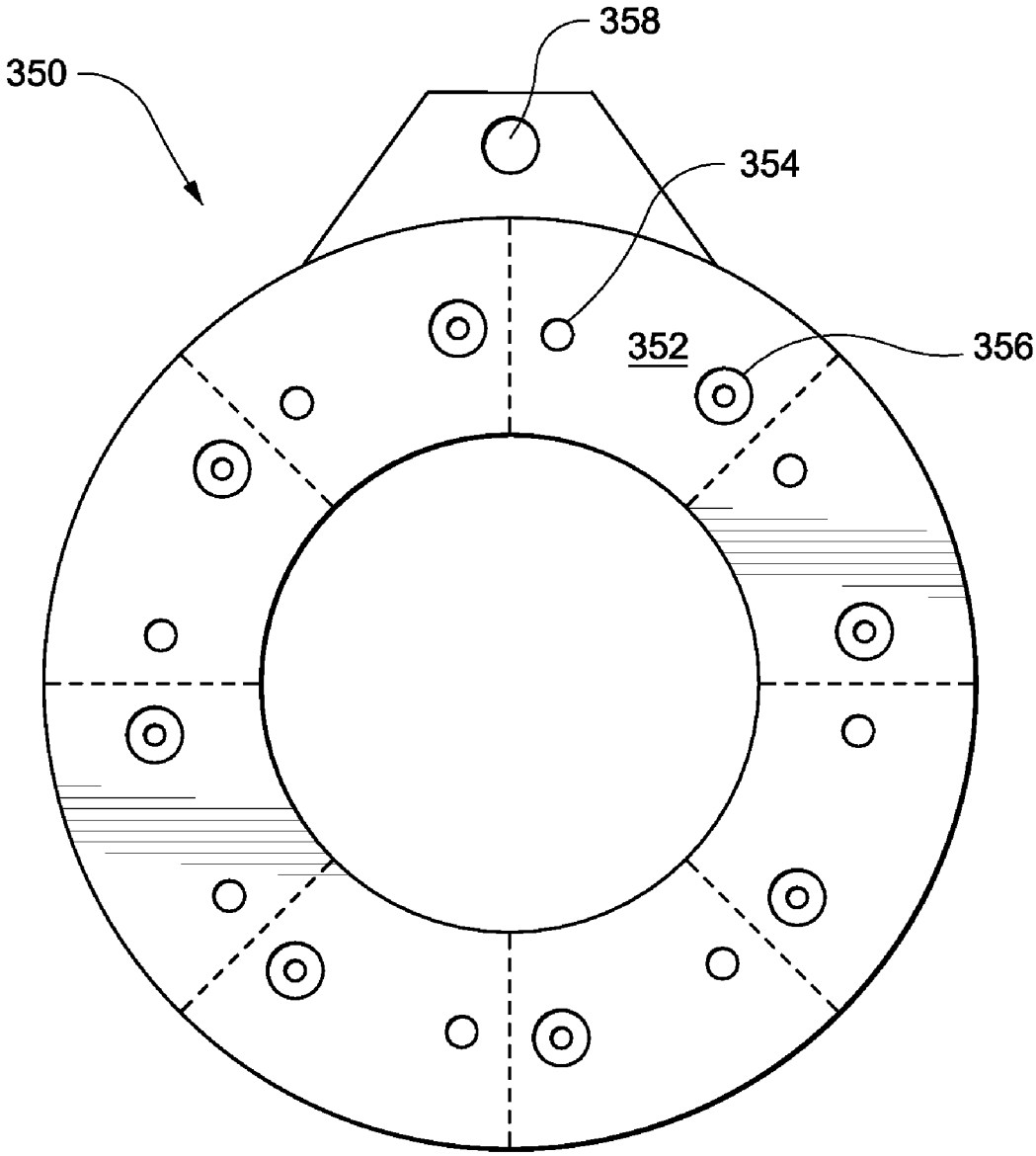
FIG. 3 schematically illustrates a face-mounted fixture in accordance with an embodiment of the present invention.

FIG. 3 schematically illustrates a face-mounted fixture 350 in accordance with an embodiment of the present invention. As illustrated, face-mounted fixture 350 may carry eight refiner plate segments (with the segment positions illustrated by the broken lines), and may be carried and positioned using lifting hole 358.

As illustrated, there are two attachment holes for each refiner plate segment: one dual-purpose hole 356 for attaching the segment to the face-mounted fixture 350 and for attaching the segment to the refiner disk, and one single-purpose hole for attaching the segment to the refiner disk. Other arrangements of dual- and single-purpose holes may also be used. In this manner, the plate segment may be partially secured to the refiner disk before being unbolted from the face-mounted fixture.

Figure 4:
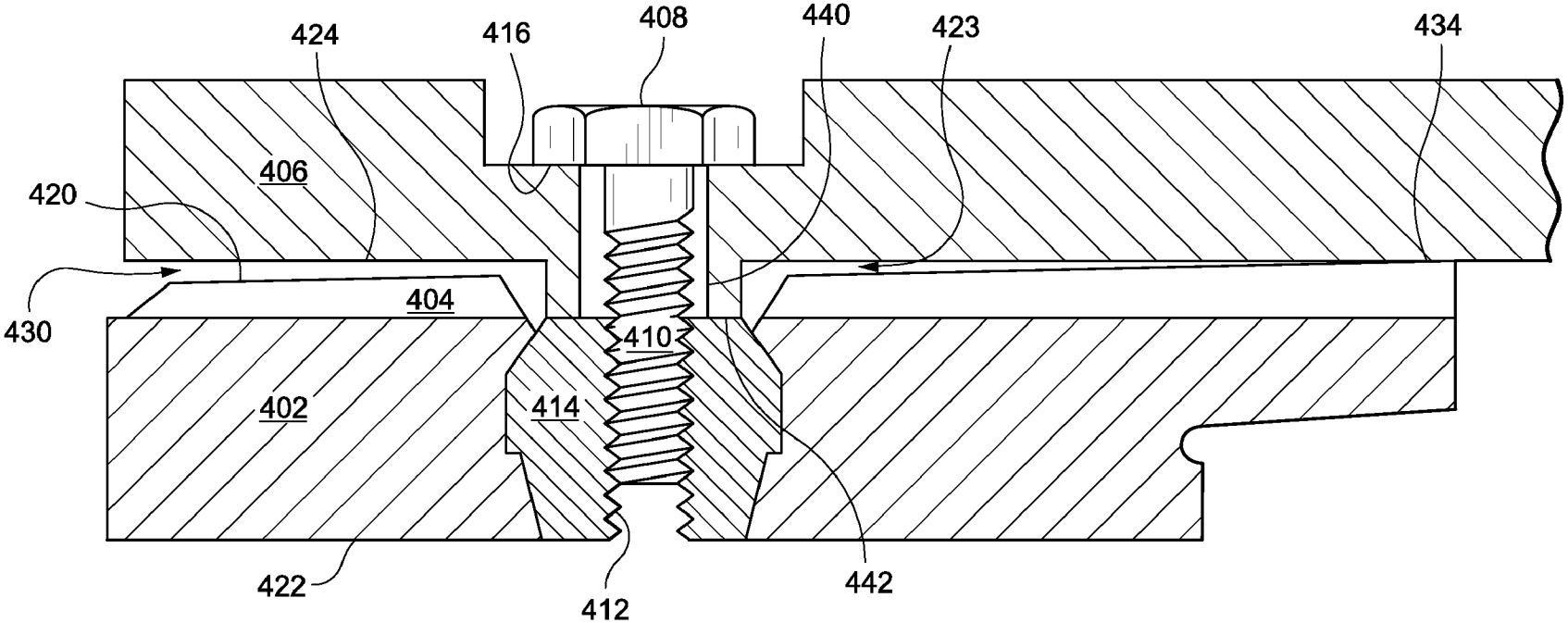
FIG. 4 schematically illustrates a face-mounted fixture in accordance with an embodiment of the present invention.

FIG. 4 schematically illustrates an assembly comprising a face-mounted carrier and refiner plate segment in accordance with an embodiment of the present invention. Refiner plate segment 402 has a top surface 420 and a bottom surface 422. Top surface 420 interfaces the lignocellulosic material during operation of the refiner, and the lignocellulosic material is pulverized using bars 404 and grooves near the top surface 420. The precise pattern (if any) of the grooves is relatively unimportant. As illustrated, top surface 420 is beveled and is thus not parallel to the bottom surface 424 of face-mounted carrier 406.

Face-mounted carrier 406 is connected to refiner plate segment 402 via bolt 410 interlocking with threads 412 of insert 414. As bolt 410 is rotated into place, head 408 cinches against face-mounted carrier 406 at interface 416. As illustrated, face-mounted carrier 406 has a collar 440 that extends beyond the bottom surface 424. Collar 440 rests against insert 414 at interface 442.

Because face-mounted carrier 406 is beveled, face-mounted carrier only contacts refiner plate segment 402 at interface 442 (at the collar 440) and interface 434 (where top surface 420 contacts the bottom surface 424 of face-mounted carrier 406). Thus, gap 430 and gap 432 are formed between face-mounted carrier 406 and refiner plate segment 402. In this respect, collar 440 (which may comprise a complete cylinder or only a portion of a cylinder) facilitates transport of various surface configurations (e.g., beveled or otherwise) of refiner plate 402. In yet further embodiments, face-mounted carrier 406 may only contact the refiner plate segment at collar 440 and not contact the plate segment grinding face at any other location.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A refiner plate segment for refining lignocellulosic material comprising:

a top surface comprising bars and grooves for refining lignocellulosic material;

a bottom surface adapted to interface with a mounting surface of a refiner;

a first hole in the top surface and a second hole in the bottom surface;

wherein the first hole comprises a threaded portion adapted to receive a first threaded bolt and wherein the second hole comprises a threaded portion adapted to receive a second threaded bolt, wherein the first hole and second hole are the same hole through the plate segment, wherein the first threaded bolt is adapted to cinch a face-mounted plate carrier between a head portion of the first threaded bolt and the refiner plate segment, and wherein the face-mounted plate carrier comprises a collar extending beyond the bottom surface, wherein the collar rests on a portion of the plate segment circumferential to the hole such that a gap is formed, wherein the gap prevents the entire surface of the bars and grooves from contacting the face-mounted plate carrier.

2. The refiner plate segment according to claim 1, wherein the first threaded bolt comprises a temporary installation bolt adapted to be removed prior to refining lignocellulosic material.

3. The refiner plate segment according to claim 1, wherein the first threaded bolt and the second threaded bolt are substantially the same bolt.

4. The refiner plate segment according to claim 1, wherein the threaded portion of the hole is machined directly into the refiner plate segment.

5. The refiner plate segment according to claim 1 further comprising an insert having a hardness less than the hardness of the bars and grooves of the refiner plate segment, wherein the threaded portion of the hole is machined directly into the insert.

6. The refiner plate segment according to claim 1 further comprising at least two holes connecting the top surface to the bottom surface, wherein each hole comprises a threaded portion adapted to receive a threaded bolt.

7. The refiner plate segment according to claim 1, wherein the collar comprises a cylinder or a portion thereof.

8. An assembly for transporting a refiner plate segment to a refiner refining lignocellulosic material comprising:

a refiner plate segment comprising:

a top surface comprising bars and grooves for refining lignocellulosic material;

a bottom surface;

a hole connecting the top surface to the bottom surface;

wherein the hole comprises a threaded portion adapted to receive a first threaded bolt from both the top surface and a second threaded bolt the bottom surface; and a face-mounted carrier adapted to be adjacent to the top portion of the refiner plate segment and adapted to receive a bolt that is threaded into the threaded portion of the refiner plate segment, wherein the face-mounted plate carrier comprises a collar extending beyond the bottom surface, wherein the collar rests on a portion of the plate segment circumferential to the hole such that a gap is formed, wherein the gap prevents the entire surface of the bars and grooves from contacting the face-mounted plate carrier.

9. The assembly according to claim 8, wherein the first threaded bolt comprises a temporary installation bolt adapted to be removed prior to refining lignocellulosic material, such that the face-mounted carrier is not adjacent to the refiner plate segment while lignocellulosic material is refined.

10. The assembly according to claim 8, wherein the first threaded bolt and the second threaded bolt are substantially the same bolt.

11. The assembly according to claim 8, wherein the refiner plate segment further comprises an insert having a hardness less than the hardness of the bars and grooves of the refiner plate segment, wherein the threaded portion of the hole is machined directly into the insert.

* * * * *